US008288950B2

(12) United States Patent
Walton et al.

(10) Patent No.: US 8,288,950 B2
(45) Date of Patent: Oct. 16, 2012

(54) APPARATUS AND METHOD FOR REGULATING THE OUTPUT OF A PLASMA ELECTRON BEAM SOURCE

(75) Inventors: Scott G. Walton, Fairfax, VA (US); Christopher D. Cothran, Fairfax, VA (US); Richard F. Fernsler, Annandale, VA (US); Robert A. Meger, Crofton, MD (US); William E. Amatucci, Fairfax, VA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 226 days.

(21) Appl. No.: 12/899,012

(22) Filed: Oct. 6, 2010

(65) Prior Publication Data

US 2011/0080093 A1 Apr. 7, 2011

Related U.S. Application Data

(60) Provisional application No. 61/248,937, filed on Oct. 6, 2009.

(51) Int. Cl.
*H05B 31/26* (2006.01)

(52) U.S. Cl. ..... 315/111.21; 315/111.61; 315/111.81

(58) Field of Classification Search . 315/111.21–111.91
See application file for complete search history.

(56) References Cited

U.S. PATENT DOCUMENTS

| | | | | |
|---|---|---|---|---|
| 4,749,912 | A * | 6/1988 | Hara et al. | 315/111.81 |
| 4,841,197 | A * | 6/1989 | Takayama et al. | 315/111.81 |
| 5,329,205 | A * | 7/1994 | Goebel et al. | 315/111.21 |
| 7,498,592 | B2 | 3/2009 | Hershkowitz et al. | |
| 2002/0047544 | A1 * | 4/2002 | Nishikawa et al. | 315/111.21 |

OTHER PUBLICATIONS

Baalrud et al., "Global nonambipolar flow: Plasma confinement where all electrons are lost to one boundary and all positive ions to another boundary," Phys. Plasmas 14 042109 (2007).

* cited by examiner

*Primary Examiner* — Tung X Le
(74) *Attorney, Agent, or Firm* — Amy Ressing; Joslyn Barritt

(57) ABSTRACT

An apparatus and method for controlling electron flow within a plasma to produce a controlled electron beam is provided. A plasma is formed between a cathode and an acceleration anode. A control anode is connected to the plasma and to the acceleration anode via a switch. If the switch is open, the ions from the plasma flow to the cathode and plasma electrons flow to the acceleration anode. With the acceleration anode suitably transparent and negatively biased with a DC high voltage source, the electrons flowing from the plasma are accelerated to form an electron beam. If the switch is closed, the ions still flow to the cathode but the electrons flow to the control anode rather than the acceleration anode. Consequently, the electron beam is turned off, but the plasma is unaffected. By controlling the opening and closing of the switch, a controlled pulsed electron beam can be generated.

17 Claims, 6 Drawing Sheets

APPARATUS AND METHOD FOR REGULATING THE OUTPUT OF A PLASMA ELECTRON BEAM SOURCE

CROSS-REFERENCE

This application claims the benefit of priority based on U.S. Provisional Patent Application No. 61/248,937 filed on Oct. 6, 2009, the entirety of which is hereby incorporated by reference into the present application.

TECHNICAL FIELD

The present invention relates to control of plasma-produced electron beams.

BACKGROUND

Electron beams are used in wide variety of technological and scientific applications such as thin film deposition, electron beam welding, electron curing, waste management, ion thrusters, and plasma generators. Pulsed electron beams are often useful in such applications because they can provide improved performance compared to continuous beams. For example, in welding, instantaneous powers well in excess of average power can be achieved to increase the weld depth, while in the processing of materials, pulsed beams can drive surface chemistries while minimizing heating of the substrate, thus allowing the treatment of heat sensitive materials.

The source of electrons for an electron beam device can be a thermionic emitter (a material heated until electrons "boil off"), a field emitter (high electric fields "rip" electrons out of a material), or a plasma (ionized gas). Most devices form electron beams by biasing the source of electrons at a negative electric potential or voltage relative to earth ground; the applied electric field accelerates the electrons from the source to form an energetic beam.

Thermionic (usually a hot filament) and field emission devices are commonly used to produce electron beams in low pressure applications; at pressures exceeding $10^{-4}$ Torr these devices typically begin to operate erratically and ultimately fail, often quickly, due to ion bombardment or exposure to reactive species such as oxygen or fluorine. Furthermore, the accumulation of electron density sets the beam current in these devices. Plasma sources of electron beams, in contrast, demonstrate stable operation at high pressures, even in reactive gases, and can produce high beam currents determined mainly by the plasma density.

A plasma is an ionized gas containing equal densities of positive (ions) and negative (electrons) charges, and is typically produced by applying either a DC (continuous) or RF (oscillating) electric field to a neutral gas.

A DC plasma source requires two electrodes, a cathode and anode, with the cathode at a negative voltage relative to the anode. The discharge current runs from the anode, through the plasma, to the cathode. Near the electrodes, a thin region (sheath) of space charge exists, while the remainder of the plasma is for all practical purposes electrically neutral. These sheaths typically are ion sheaths (i.e., contain excess positive charge density), with the plasma at a higher potential than at any electrode.

A cathode that is not hot enough to emit thermionically is called a "cold" cathode. Such cold cathode discharges are the most commonly used DC plasma sources. Ion-induced secondary electron emission from the cathode is required to sustain these discharges, where the electrons liberated at the cathode surface due to ion bombardment gain enough energy as they accelerate away from the negatively biased cathode to ionize the neutral gas, thus countering the diffusive processes tending to dissipate the plasma.

When the cathode is hollow (cylindrically shaped, for example) the plasma can fill the interior of the cathode. Such hollow cathode discharges are extremely efficient plasma sources and can produce very large plasma densities. Secondary electrons are electrostatically trapped between opposing cathode walls due to the geometry of the cathode, therefore effectively guaranteeing that they will not leave the plasma volume before producing the ionization required to sustain the discharge.

A plasma can be sustained by an RF discharge in an analogous manner, except that the electrons producing the ionization gain their energy from the oscillating RF electric field rather than from the DC electric field at the cathode as in cold cathode discharges.

Independent of the method used to ionize and sustain the plasma, there will always be a flux of ions and electrons out of the plasma that is countered by the ionization source. A plasma electron beam device takes advantage of this natural flux of electrons from the plasma to produce an electron beam. Just as for thermionic or field emission sources, when the plasma is biased negatively relative to ground, electrons leaving the plasma are accelerated by the applied voltage to form the energetic electron beam.

The largest possible electron current available from a plasma source is equal to the total ion current leaving the plasma; this follows from the quasineutrality requirement, for if the two currents were not equal, ions and electrons would be leaving at different rates and the device would charge. For a two-electrode device such as a hollow cathode plasma source, this maximum electron current can be made available at the anode where it is most convenient for the purpose of producing an electron beam. This happens when the plasma potential is negative relative to the anode by several multiples of the ion temperature. In this case, ion flux to the anode is shut off since most ions will not have enough energy to climb the potential barrier, so there is only an electron flux to the anode, i.e., an electron sheath forms at the anode. For similar reasons, there is primarily ion flux to the cathode since the cathode is more negative than the plasma by several multiples of the electron temperature, i.e., an ion sheath forms at the cathode. Consequently, the only significant electron flow from the plasma occurs at the anode.

In an electron beam device using a two-electrode plasma electron source, a large fraction of the electron current to the anode becomes the beam current, limited for practical reasons by the physical transparency of the anode which is usually a wire mesh. The plasma discharge current, which is dependent most strongly on the plasma density and cathode area, with weaker dependence on the electron temperature, therefore directly determines the beam current. A negative voltage applied to the whole plasma source, typically between the anode and earth ground, determines the beam energy.

For certain combinations of beam energy, gas pressure outside the plasma source, and beam current, great care must be taken to avoid electrical breakdown in the acceleration region (i.e., between the anode of the plasma source and earth ground). The beam electrons can ionize neutral gas in this region, so maintaining separation between this beam-generated plasma and the plasma in the electron source is important. A high voltage discharge can result if the two plasmas become connected so that a conducting path to earth ground exists. This can lead to uncontrolled output, unsteady operation, component damage, or source failure. Pulsed operation of the electron beam can mitigate this problem.

Although a pulsed beam is necessary and advantageous for some applications, pulsed operation of plasma-based electron beam sources can present a number of difficulties. Often, the plasma itself is turned on and off, thus requiring the plasma to be re-established by electrical breakdown of the neutral gas ("ignition") and then allowed to settle to the necessary operating conditions for every beam pulse. For hollow cathode plasmas, this is particularly difficult since ignition requires much higher initial neutral pressures and voltages than is needed after the plasma attains a steady state. Although ignition of the plasma is easier with an RF source, both DC and RF discharges suffer from changing plasma conditions as the plasma evolves from breakdown to a stable operating point, thus limiting the pulse duration and repetition rate.

It is therefore advantageous for the plasma source to be running continuously while the beam output is simply turned on and off. Although pulsed beam output can be obtained from a DC plasma source using a pulsed high voltage power supply to accelerate the beam, such power supplies are significantly more complicated and expensive than DC high voltage power supplies.

SUMMARY

This summary is intended to introduce, in simplified form, a selection of concepts that are further described in the Detailed Description. This summary is not intended to identify key or essential features of the claimed subject matter, nor is it intended to be used as an aid in determining the scope of the claimed subject matter. Instead, it is merely presented as a brief overview of the subject matter described and claimed herein.

The present invention provides an apparatus and method for controlling electron flow from a plasma source to control an electron beam.

An apparatus to control electron flow within a plasma source and produce an electron beam in accordance with the present invention can include a standard two-electrode (cathode and anode) hollow cathode plasma discharge with the addition of a third electrode for control of the electron flow within the plasma. In the present disclosure, the anode in the standard configuration is often referred to as the "acceleration anode" to indicate its role in determining the beam energy, while the third electrode is often referred to as the "control anode" to indicate its role in controlling the electron flow.

In accordance with the present invention, the control anode is connected to the acceleration anode by means of a switch. In an exemplary configuration described herein, the plasma is formed within a hollow cathode. With the plasma discharge operating, ions flow to the cathode walls irrespective of the state of the switch (open or closed). Electron flow, however, does depend on the state of the switch. If the switch is open, all of the electrons flow to the acceleration anode. If the switch is closed, however, all of the electrons in the plasma flow to the control anode, with no electrons flowing to the acceleration anode.

The electron flow within the plasma can thus be controlled and redirected from the control anode to the acceleration anode at will. Such a plasma source can function as an electron beam device when it is biased with a continuously applied (DC) negative high voltage supply. When the switch is open and electrons are flowing out of the source via the acceleration anode, the beam current is on. When the switch is closed, electrons flow instead to the control anode and the beam current is off.

Thus, in accordance with the present invention, the electron beam can be easily turned on and off by opening and closing the switch between the control anode and the acceleration anode while continuously operating the plasma source and continuously applying voltage on the acceleration anode. With the apparatus and method in accordance with the present invention, it is possible to maintain a continuous discharge and continuous voltages on the accelerating elements while regulating the output as desired, for example, by turning the electron beam on and off or pulsing the electron beam at a desired pulse width and duty factor, thus providing greater control of the electron beam produced by plasma sources.

DETAILED DESCRIPTION

The aspects and features of the present invention summarized above can be embodied in various forms. The following description shows, by way of illustration, combinations and configurations in which the aspects and features can be put into practice. It is understood that the described aspects, features, and/or embodiments are merely examples, and that one skilled in the art may utilize other aspects, features, and/or embodiments or make structural and functional modifications without departing from the scope of the present disclosure.

The apparatus and method of operation described in this disclosure provide a means to regulate the output of a plasma-based electron beam source by turning the electron beam on and off as desired without having to ignite and extinguish the plasma and without having to use a pulsed high voltage power supply.

An apparatus to control electron flow within a plasma source and produce an electron beam in accordance with the present invention includes a plasma source operatively connected to a cathode and an anode, and further includes a third electrode for control of the electron flow within the plasma. In an exemplary configuration described herein, a hollow cathode plasma source is used, although one skilled in the art will appreciate that the methods described herein can be used with any appropriate plasma source. In addition, in the present disclosure, the anode is often referred to as the "acceleration anode" to indicate its role in determining the beam energy, while the third electrode is often referred to as the "control anode" to indicate its role in controlling the electron flow.

In accordance with the present invention, a control anode is added to a hollow cathode plasma source. When electrically connected to the acceleration anode, the control anode directs electron flow away from the acceleration anode, thus controlling the electron flow within the plasma. Only when the switch is open so that the control anode is electrically isolated do electrons flow to the acceleration anode to become the beam current. Thus, by controlling the electrical connection or isolation of the control anode, e.g., via a simple electronic switch, a controlled pulsed electron beam having a desired pulse width and/or duty factor can be produced.

The present invention will now be described in the context of the attached Figures, which are incorporated into and form a part of the disclosure herein.

Figure 1:
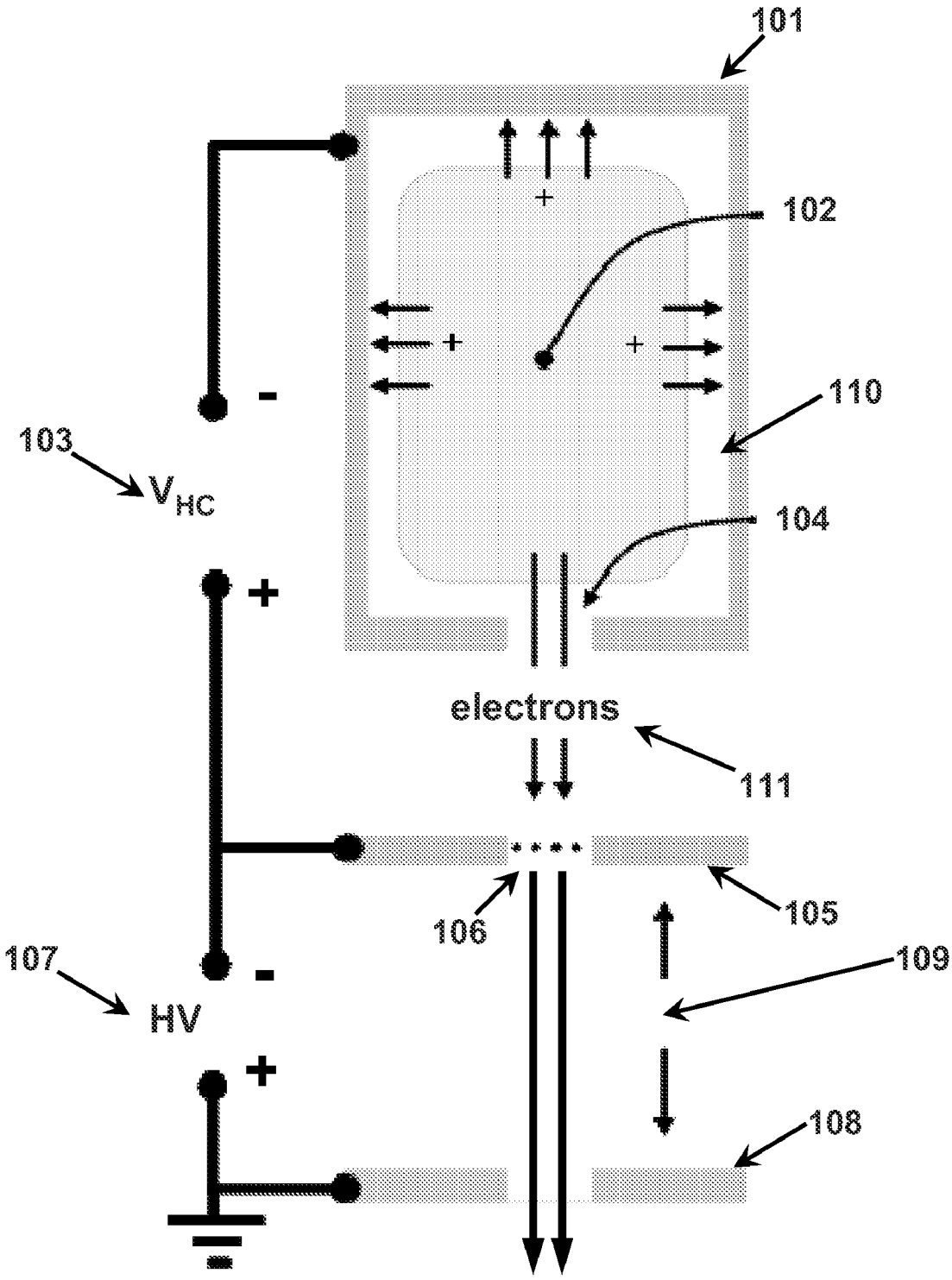
FIG. 1 Prior Art
FIG. 1 is a block diagram illustrating a typical hollow cathode electron beam source in accordance with the prior art.

FIG. 1 depicts an exemplary configuration of a conventional typical hollow cathode electron beam source, along with an exemplary biasing circuit for the production of electrons from the plasma. See S. G. Walton, R. F. Fernsler, and R. A. Meger, "Development of a compact, high energy electron beam source," Presentation at the 61st Gaseous Electronics Conference, Dallas, Tex. (October, 2008); and C. D. Cothran, S. G. Walton, R. F. Fernsler, and W. E. Amatucci, "Continuous multi-keV electron beam source using a hollow cathode," Poster presentation at the 36th International Conference on Plasma Science (ICOPS), San Diego, Calif. (June, 2009).

Thus, as seen in FIG. 1, such a conventional plasma-based electron beam source can comprise a hollow cavity cathode 101 containing a gas. As described above, when a neutral gas flows through the device and a negative DC voltage source 103 is applied between the hollow cathode 101 and an acceleration anode 105 having an effective surface area 106, a plasma 102 is produced within the cavity. The plasma thus produced in a hollow cathode is often referred to in the art as a "hollow cathode plasma source." As described below, if the dimensions of the hollow cathode and the effective surface area of the acceleration anode are correct, the positive ions produced by the ionization will flow to the walls of the hollow cathode 101 and the electrons will flow out of exit orifice 104 to acceleration anode 105.

Figure 2:
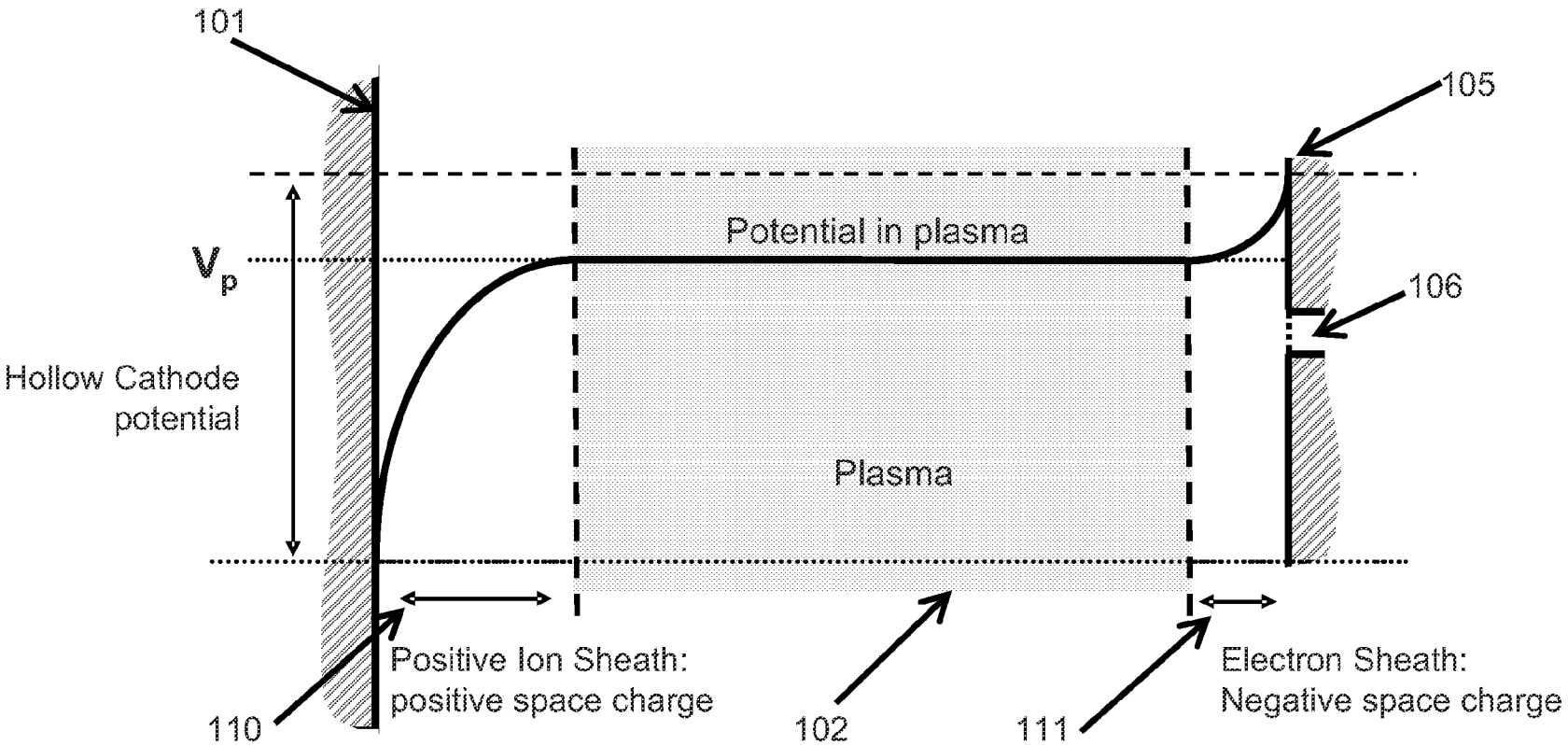
FIG. 2 is a plot showing a potential profile for an exemplary hollow cathode plasma source suitable for use in accordance with the present invention.

The electrostatics involved in this process are illustrated by the plot shown in FIG. 2, where the identified elements have the same numbering as in FIG. 1. Thus, as illustrated in FIG. 2, the geometry of the hollow cathode 101 causes sheath inversion at acceleration anode 105, such that acceleration anode 105 is at the highest potential. The plasma potential is typically 20V or more lower than the potential at the acceleration anode, and potential at the cathode wall is lower yet. Almost all of the discharge voltage (about 300V in Argon) is realized over ion sheath 110 at the walls of cathode 101. Thus, the positive ions leave plasma 102 mainly through cathode ion sheath 110, while the electrons leave mainly through electron sheath 111 at acceleration anode 105. The effective surface area 106 of the acceleration anode 105 is largely determined by the size of exit orifice 104, particularly when the plasma source is operated in an axial magnetic field.

As noted above, the physical properties of electron and ion sheaths and the condition equating the electron current and ion current at the two electrodes (quasineutrality) sets the following condition on the ratio of the surface area of the anode and cathode:

$$\frac{A_A}{A_K} \leq \sqrt{\frac{m_e}{m_i}}$$

where $A_A$ is the surface area of the acceleration anode, $A_K$ is the surface area of the cathode, e.g., in this exemplary embodiment, the surface area of the interior cavity walls, $m_e$ is the electron mass, and $m_i$ is the ion mass. See Baalrud et al., "Global nonambipolar flow: Plasma confinement where all electrons are lost to one boundary and all positive ions to another boundary," *Phys. Plasmas* 14 042109 (2007); and U.S. Pat. No. 7,498,592 to Hershkowitz et al.

Acceleration anode 105 can take any suitable form that permits the electrons to pass therethrough to the acceleration region 109, with effective surface area 106 being formed by, e.g., a partially transparent material, a perforated foil, fine wire mesh, or a metal plate drilled with a small hole. The electrons thus emitted from the plasma 102 can be accelerated across an acceleration gap 109 by applying a potential difference 107 between acceleration anode 105 and another electrode 108, which is typically at earth ground, to form an electron beam exiting through an orifice in ground electrode 108. This beam will have an energy commensurate with the voltage 107 across the acceleration gap 109. Thus, the energy of the electron beam formed from a plasma source is largely determined by the voltage on acceleration anode 105, while the beam current is controlled by the density of the plasma 102 inside the hollow cathode 101.

As noted above, precise control of the electron beam is useful in many applications. Manufacturing applications such as electron beam welding require the beam to be applied only when the parts being joined are correctly positioned, for example. Pulsed beams in materials processing applications are useful to delicately control the ion flux from the beam-generated plasma onto a substrate.

Pulsed operation with plasma-based electron beam sources is often accomplished by turning the whole plasma source on and off, requiring the plasma to be re-established from electrical breakdown (ignition) to the required operating conditions for each beam pulse, leading to the undesirable consequence of changing plasma conditions and therefore changing beam characteristics during the pulse. Control of the electron beam while maintaining continuous discharge in the plasma source and the simplicity of a continuously applied beam voltage is significantly advantageous.

As noted above, the present invention provides an apparatus and method for controlling the flow of electrons from a plasma source such as a hollow cathode plasma source to create a controlled, pulsed electron beam output. In accordance with the present invention, an additional anode, referred to herein as a "control anode," is placed within a plasma source.

Figure 3:
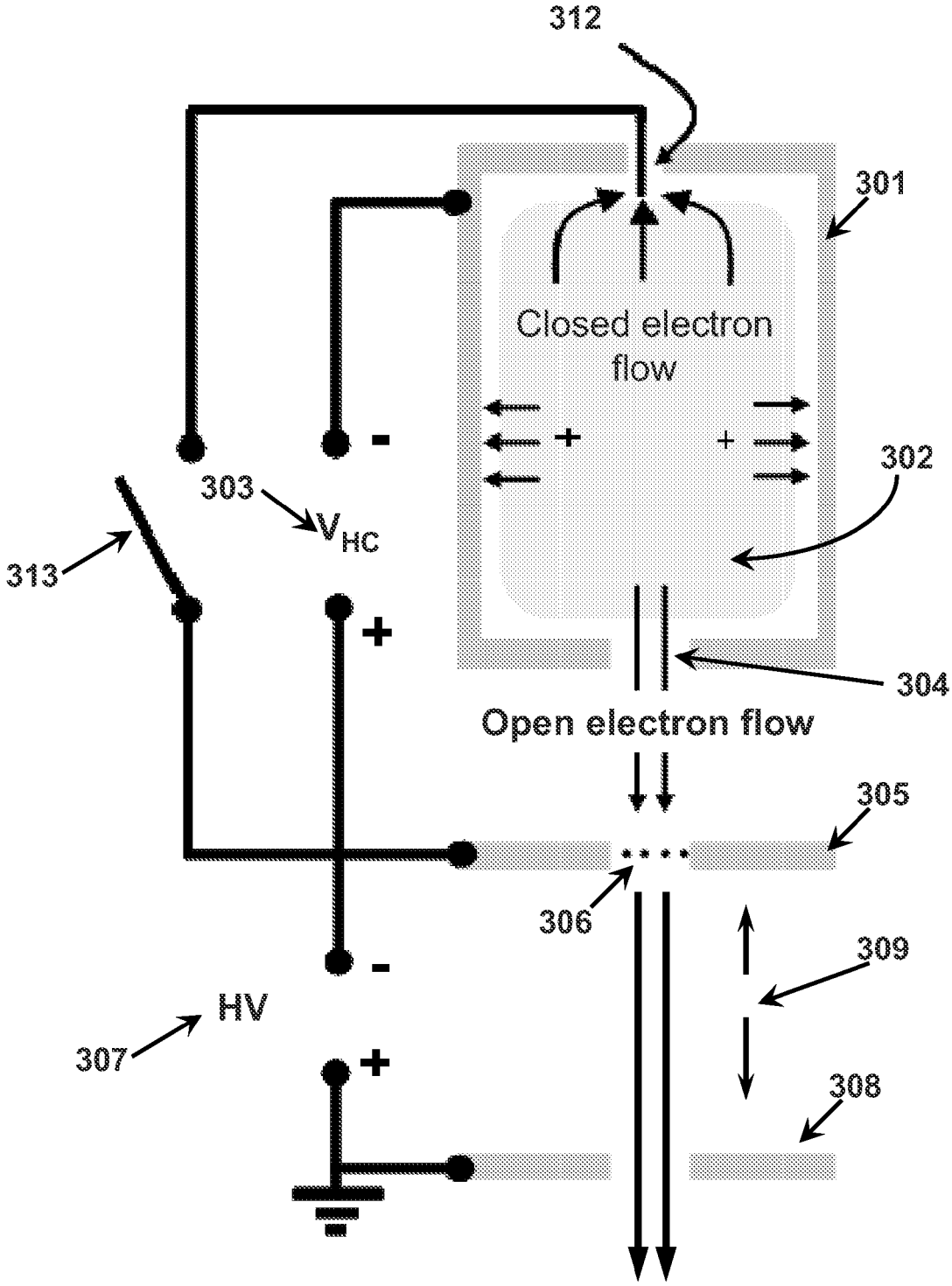
FIG. 3 is a block diagram illustrating an exemplary embodiment of an apparatus for producing a controlled electron beam in accordance with the present invention.

An exemplary configuration of such an apparatus in accordance with the present invention is illustrated in FIG. 3.

Thus, as shown in FIG. 3, an apparatus for controlling the electron flow within a plasma source can include a control anode 312 situated within a plasma 302 and connected to voltage source 303 by means of a switch 313 between the control anode 312 and acceleration anode 305. In the exemplary configuration shown in FIG. 3, the plasma 302 fills the interior of the hollow cavity cathode 301 such as that described above with respect to FIG. 1, but one skilled in the art would recognize that other embodiments are possible, and such other embodiments are also within the scope of the present disclosure.

In accordance with the present invention, the electron flow within the plasma 302 can be controlled by electrically connecting or disconnecting the control anode 312 to the acceleration anode 305 via switch 313. In an exemplary embodiment such as that illustrated in FIG. 3, control anode 312 can be a small wire loop located at the back side of the cathode opposite the exit orifice 304 which has an exposed surface area $A_C$ that is approximately the same as the effective surface area 306 of acceleration anode 305 such that the criterion for formation of an electron sheath at the control anode is satisfied, i.e., $$\frac{A_C}{A_K} \leq \sqrt{\frac{m_e}{m_i}}.$$

In the same manner as described above with respect to the plasma-filled hollow cathode shown in FIG. 1, when a neutral gas flows through the hollow cathode 301 and a negative DC voltage 303 is applied across the cathode and anode, a plasma 302 is produced within cathode 301. When switch 313 is open, control anode 312 is electrically isolated and floats close to the plasma potential. This state is essentially identical to the case described above with respect to FIG. 1 where the control anode is absent; i.e., the positive ions flow to the walls of the cathode 301 and the electrons flow out of exit orifice 304 to the acceleration anode 305 where they are then accelerated across acceleration gap 309 by applying a potential difference 307 between acceleration anode 305 and electrode 308 to form an electron beam.

However, when switch 313 is closed, control anode 312 is at the same potential as acceleration anode 305. In such a case, the two anodes do not share the discharge current; instead, the discharge current is routed entirely through the electron sheath formed at control anode 312. Since the discharge current is carried by electrons at the anode and ions at the cathode in a hollow cathode plasma discharge with the appropriate ratio of cathode surface area to effective anode surface area, control anode 312 is now collecting all of the electrons leaving the hollow cathode plasma 302. Consequently, when switch 313 is closed, the flow of electrons from the plasma is diverted entirely to control anode 312, with no electrons flowing out of exit orifice 304 to acceleration anode 305. The absence of electron flow to acceleration anode 305 when the switch is closed means that the beam has been turned off. Thus, in accordance with the present invention, the flow of the electrons from the plasma source can be controlled to produce a pulsed electron beam simply by opening or closing the switch 313.

In many embodiments, an optically coupled signal can be used to drive the switching so that no electrical contact is necessary with the electronic switch which is biased along with the plasma source to negative high voltage for beam production. With no signal, the control anode floats, while with a signal present, the control anode is electrically connected to the acceleration anode and electrons flow to the control anode as described above.

Figure 4:
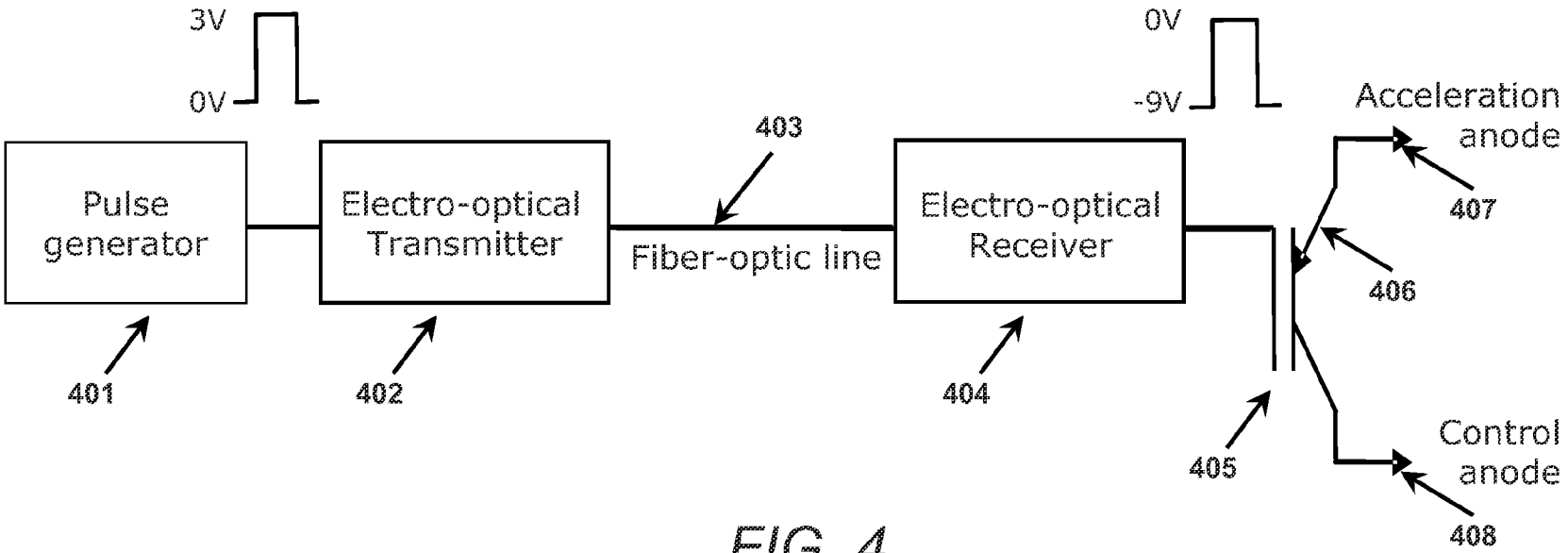
FIG. 4 is a block diagram illustrating an exemplary electronic switch suitable for use in accordance with the present invention.

An exemplary electronic switching circuit that can be used in an apparatus for producing a controlled pulsed electron beam in accordance with the present invention is illustrated in FIG. 4. Thus, as shown in FIG. 4 such a circuit can include a pulse generator 401, electro-optical transmitter 402, fiber optic line 403, electro-optical coupling (receiver and drive electronics) 404, and transistor 405 with source 407 and drain 408 terminals connected to the acceleration anode and control anode, respectively. An electrical pulse drives a light emitting diode in the electro-optical transmitter 402 to send a pulse of light to the electro-optical receiver 404. This optical pulse is converted back to an electrical pulse relative to the potential of the acceleration anode (at negative high voltage) by the electro-optical receiver and drive electronics 404. When the optical pulse arrives, these electronics drive the transistor into saturation so that a conducting path exists from the acceleration anode to the control anode, thus redirecting electron flow within the plasma from the acceleration anode to the control anode and the beam is turned off as previously described. These electronics can be powered by any appropriate power source, e.g., by two 9V batteries. Of course, the circuit illustrated in FIG. 4 is merely exemplary, and one skilled in the art would readily recognize that other appropriate switches and configurations thereof also can equally well be used to control the operation of the control anode in accordance with the present invention.

EXAMPLE

An exemplary embodiment of the present invention tested by the inventors hereof will now be described. In this exemplary embodiment, a 7.5 cm long cylindrical stainless steel hollow cathode with an interior cathode surface area ($A_K$) of 50 $cm^2$. Due to the applied magnetic field, the exit orifice surface area of the cathode determines the effective surface area of the acceleration anode ($A_A$) relevant for the formation of the electron sheath. Thus, with the exit orifice area 0.03 $cm^2$, the ratio of the effective area of the acceleration anode to the area of the hollow cathode was $$\frac{A_A}{A_K} = 6 \times 10^{-4}.$$

Argon gas was fed into the back side of the cathode. For an argon discharge, the square root of the electron-to-ion mass ratio was $$\sqrt{\frac{m_e}{m_i}} = 3.7 \times 10^{-3}.$$

Thus, the criterion described above for an electron sheath to be present, $$\frac{A_A}{A_K} \leq \sqrt{\frac{m_e}{m_i}},$$

was satisfied.

The acceleration anode was located approximately 0.05 cm from the cathode exit and was made of stainless steel mesh (150 lines/in.), which provided a reasonably transparent and uniform potential surface. The control anode for redirecting the electron flow, and therefore for controlling the electron beam output, was a loop of 0.42 mm diameter Nichrome wire held in a four-bore ceramic rod fed through the cathode back wall at the same location of the gas feed. The exposed surface area ($A_C$) of this control anode wire loop was comparable to the surface area of the acceleration anode ($A_A$) so that an electron sheath could form at this anode as well. Note that the total surface area of the front and back anodes $A_T = A_A + A_C$ also satisfies the criterion for establishing an electron sheath. A 0.6 cm gap separated the acceleration anode from the ground anode.

The device was mounted to a vacuum chamber equipped with an axial set of magnetic field coils. In addition to the device field coils, another (axial) magnetic field coil surrounded the vacuum chamber into which the beam was injected. The hollow cathode was operated with up to 170 G applied in both regions. A beam dump, located at the far end of the vacuum chamber was used to measure the beam current; the total propagation region, equal to the vacuum chamber length, was approximately 50 cm. Neutral gas was continuously fed through the cathode and pumped out via a turbomolecular pump on the chamber. Although not critical to this disclosure, the small exit aperture on the hollow cathode constricted gas flow from the cathode, thereby establishing a large pressure differential between the cathode cavity and the vacuum chamber. The turbomolecular pump could be throttled to adjust the neutral pressure in the chamber. Chamber pressures in the range of 0.02 to 1.0 mTorr were used. The plasma was ignited by raising the neutral pressure of Argon in the cathode until electrical breakdown of the gas occurred; with 500 V on the cathode, this requires about 2 Torr. The pressure was lowered and the hollow cathode plasma could be maintained reliably with pressures as low as about 80 mTorr. When operated without a regulated output (FIG. 1(*a*)), the device produced up to 150 mA of beam current (measured on the beam dump) and up to 5 kV of beam energy (applied voltage on the acceleration anode).

Figure 5:
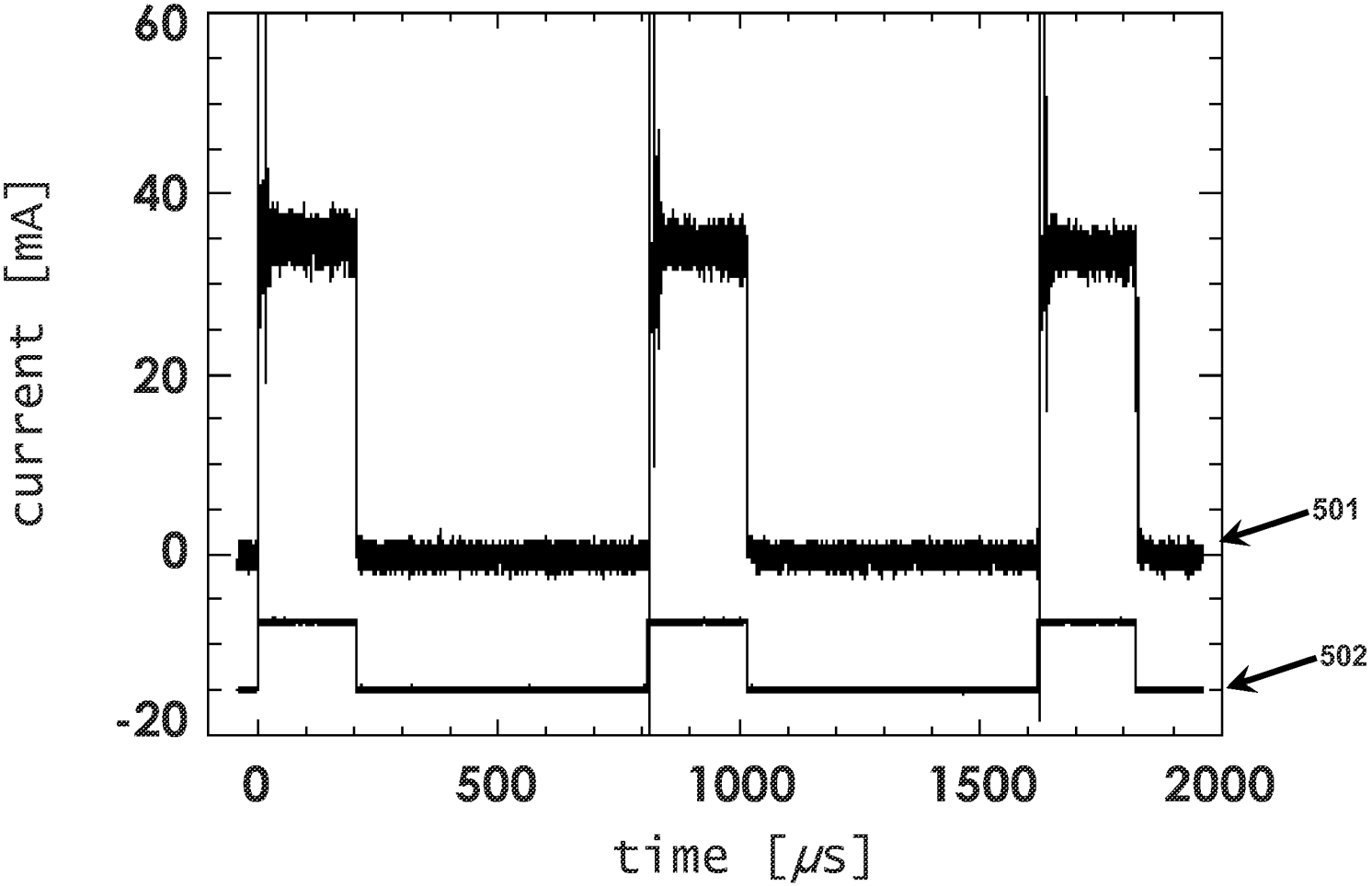
FIG. 5 is a plot of electron beam current produced in accordance with the present invention.

FIG. 5 is a plot showing a beam current 501 and a control signal 502 for an accelerating potential of 1.0 kV, cathode pressure of about 130 mTorr, chamber pressure of 0.05 mTorr, and cathode current of 80 mA, cathode magnetic field 170 G, and no chamber magnetic field. The beam output measured at the beam dump was controlled in 200 μs bursts at a 1.25 kHz repetition rate. The current in each burst was relatively constant at 40 mA. The fraction of beam dump current to cathode current was consistent with that obtained with the device operating in the conventional manner to produce a continuous beam; i.e. when operated with the control anode floating.

Figure 6:
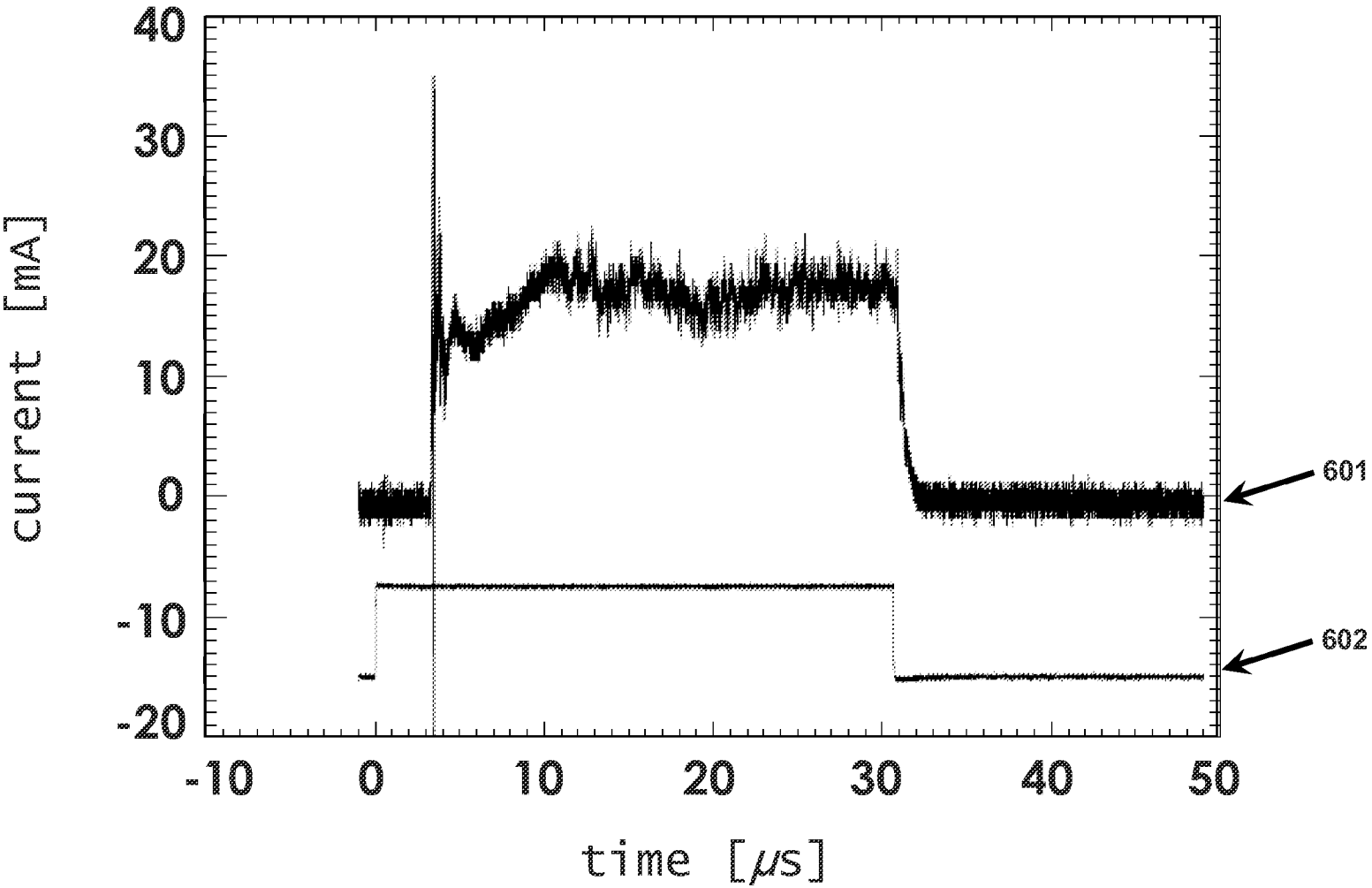
FIG. 6 is a plot of a single pulse of electron beam current produced in accordance with the present invention.

The turn-on and turn-off characteristics of the beam are shown in FIG. 6 for a single 30 μs wide pulse. The current pulse shows a 3-4 μs long delay relative to the control signal 602 before the beam current 601 was measured at the beam dump. A time-of-flight delay of about 0.03 μs is expected for the electrons to travel from the device to the beam dump; the origin of the additional delay time is unknown, but is presumably related to the time required for the plasma to rearrange the current flow to the acceleration anode. Some transient variation in the beam current is seen, but after about 6 μs the beam current becomes relatively stable. There are some inductive effects associated with the switching and the lengths of the cables and resistance of the cathode power supply, but this does not account for all of the transient response. The off transition is characterized by a decay time constant of about 2.5 μs.

No beam current was observed at the beam dump when the switch was closed so that the control anode was electrically connected to the acceleration anode. In addition, all of the discharge current was observed to run through the control anode with the switch closed. Therefore, all of the electron flow in the hollow cathode plasma discharge was diverted to the control anode when the control anode is electrically connected to the acceleration anode, i.e., when the switch is closed. In other words, the electron beam from the plasma source was turned "off" when the switch was closed and turned "on" when the switch was opened. Thus, in accordance with the present invention a controlled pulsed electron beam was produced by the closing and opening of the switch.

The primary advantage gained by controlling the electron flow within a plasma discharge is that a pulsed electron beam device can be constructed using a steady, continuously operating (DC) plasma discharge and a DC high voltage power supply. Steady plasma conditions are much more desirable than alternate plasma based electron beam devices that require the plasma to be ignited and extinguished for each beam pulse; in such devices the plasma conditions are steadily changing, from ignition to decay, and these transient behaviors directly affect the beam output. In the approach described in this disclosure, the plasma conditions, of most importance the density, are steady because the discharge is operated continuously. Furthermore, it is advantageous that the DC high voltage bias guarantees that the beam electrons have a fixed energy for the duration of a beam pulse; in other approaches using a pulsed high voltage supply, the beam energy will vary during the rise and fall of the high voltage pulse. Other approaches using control grids placed in the beam after it is extracted from the plasma at the acceleration anode present an additional physical obstruction (the grid) which decreases the available beam current; furthermore, the grid requires an additional power supply. In contrast, the control anode used in the approach described in this disclosure does not obstruct the beam, and the electronic switch requires very little power.

As noted above, the apparatus and method in accordance with the present invention can control the flow of electrons in a plasma, for example, to control the flow of electrons forming an electron beam. In addition, some embodiments of the apparatus in accordance with the present invention can include multiple control anodes placed within the plasma, each connected to the accleration anode by a corresponding switch, and thus, by opening or closing any one or more of the switches, the electron flux within the plasma can be directed to any one or more of the control anodes at will, with or without the production of an electron beam exiting the plasma source.

Although particular embodiments, aspects, and features have been described and illustrated, it should be noted that the invention described herein is not limited to only those embodiments, aspects, and features. It should be readily appreciated that modifications may be made by persons skilled in the art, and the present application contemplates any and all modifications within the spirit and scope of the underlying invention described and claimed herein. For example, one might vary one or more of the size, shape, and location of the control anode within the hollow cathode cavity. Also, rather than a switch one might connect a variable power supply to the control anode to source a varying amount of the discharge current, instead of all or none of it, and therefore provide a means for continuous control of the beam current in time (for example, slowly ramp up the beam current).

These and any other suitable embodiments are also contemplated to be within the scope and spirit of the present disclosure.

What is claimed is:

1. An apparatus for controlling a flow of electrons within a plasma, comprising:

a cathode operatively connected to a plasma;

a first anode configured to receive a flow of electrons from the plasma;

a voltage source operatively connected to both the cathode and the first anode; and a second anode configured to receive a flow of electrons from the plasma, the second anode being operatively connected to the plasma and operatively connected to the voltage source via a switch between the second anode and the first anode;

wherein when the switch is open the electrons from the plasma discharge flow to the first anode; and wherein when the switch is closed the electrons from the plasma discharge flow to the second anode.

2. The apparatus according to claim 1, wherein the voltage difference between the first and second anode is varied in time such that the flow of electrons to the one of the first and second anodes varies in time.

3. The apparatus according to claim 1, further comprising a plurality of second anodes, each of the second anodes operatively connected to the voltage source via a corresponding switch, wherein the electron flow from the plasma discharge can be selectively directed to one of the plurality of second anodes by selectively opening and closing the corresponding switch.

4. The apparatus according to claim 1, wherein the cathode comprises a hollow cavity cathode, the plasma being situated within the hollow cavity cathode;

wherein the first anode is situated outside the hollow cavity cathode and the second anode is situated within the hollow cavity cathode; and wherein the electrons flow out of the hollow cavity cathode to the first anode when the switch is open and do not exit the hollow cavity cathode when the switch is closed.

5. An apparatus for the controlled production of an electron beam, comprising:

a plasma;

a cathode and an acceleration anode operatively connected to the plasma, the acceleration anode being partially transparent to electrons;

a first voltage source applied between the cathode and the acceleration anode;

a control anode operatively connected to the plasma and operatively connected to the acceleration anode by a switch; and a second voltage source operatively connected to the acceleration anode, the second voltage source being configured to accelerate electrons away from the acceleration anode;

wherein if the switch is open, electrons from the plasma flow to the acceleration anode and are subsequently accelerated to form a beam and if the switch is closed, electrons from the plasma flow to the control anode, the redirection of the electron flow caused by the opening and closing of the switch comprising a controlled production of an electron beam.

6. The apparatus according to claim 5, wherein the flow of electrons to the acceleration anode is turned on and off by the opening of the switch such that the electron beam comprises a controlled pulsed electron beam.

7. The apparatus according to claim 5, wherein the voltage difference between the acceleration anode and the control anode is varied in time such that the electron beam current varies in time with the variation in voltage difference.

8. An apparatus for the controlled production of an electron beam, comprising:

a hollow cathode plasma source having an exit orifice at a first end of the cathode cavity;

an acceleration anode which is partially transparent to electrons situated outside the cavity opposite the exit orifice and operatively connected to a first voltage source providing a voltage between the cathode and acceleration anode;

a control anode situated at least partially within the cavity and operatively connected to the voltage source by a switch between the control anode and the acceleration anode; and a second voltage source operatively connected to the acceleration anode, the second voltage source being configured to accelerate electrons away from the acceleration anode;

wherein if the switch is open when the plasma is present, electrons from the plasma flow out of the cavity through the exit orifice to the acceleration anode and are subsequently accelerated to form a beam, and if the switch is closed when the plasma is present, electrons from the plasma flow to the control anode; and wherein the electron flow caused by the opening and closing of the switch comprises a controlled production of an electron beam.

9. The apparatus according to claim 8, wherein the flow of electrons to the acceleration anode is turned on and off by the opening of the switch such that the electron beam comprises a controlled pulsed electron beam.

10. The apparatus according to claim 8, wherein the voltage difference between the acceleration anode and the control anode is varied in time such that the electron beam current varies in time with the variation in voltage difference.

11. The apparatus according to claim 8, wherein the control anode comprises a wire loop having an effective surface area approximately equal to an effective surface area of the exit orifice.

12. A method for controlling a flow of electrons within a plasma, comprising:

operatively connecting a cathode and a first anode to a plasma;

applying a voltage between the cathode and the first anode;

operatively connecting a second anode to the plasma, the second anode further being operatively connected to the first anode by a switch;

opening the switch to cause electrons from the plasma to flow to the first anode; and closing the switch to cause electrons from the plasma to flow to the second anode.

13. A method for producing a controlled electron beam, comprising:

operatively connecting a cathode and an acceleration anode to a plasma, the acceleration anode being partially transparent;

operatively connecting a control anode to the plasma, the control anode being operatively connected to the acceleration anode by a switch;

operatively connecting the cathode and the acceleration anode to a first voltage source;

operatively connecting the acceleration anode to a second voltage source, the second voltage source being configured to accelerate electrons away from the acceleration anode;

applying a voltage from the first voltage source between the cathode and the first anode;

opening the switch to cause substantially all of the electrons from the plasma to flow from the plasma to the acceleration anode, the electrons further passing through the acceleration anode and being subsequently accelerated by the second voltage source to form an electron beam; and closing the switch to cause substantially all of the electrons from the plasma to flow to the control anode, the electrons flowing to the control anode not forming an electron beam.

14. The method according to claim 13, further comprising periodically opening and closing the switch to form a controlled pulsed electron beam.

15. The method according to claim 13, wherein an energy of the controlled electron beam is dependent on the voltage applied to the acceleration anode from the second voltage source and the beam current is dependent on the density of the plasma.

16. The method according to claim 13, wherein the voltage difference between the acceleration anode and control anode is varied in time such that the electron beam current varies in time with the variation in voltage difference.

17. The method according to claim 13, wherein the plasma source comprises a hollow cathode plasma source.

* * * * *